US007431656B2

(12) United States Patent
Titus

(10) Patent No.: US 7,431,656 B2
(45) Date of Patent: Oct. 7, 2008

(54) HYBRID BILLIARD CUE SHAFT

(75) Inventor: Stephen Titus, Daytona Beach, FL (US)

(73) Assignee: Clawson Custom Cues, Inc., Jacksonville, FL (US)

( * ) Notice: Subject to any disclaimer, the term of this patent is extended or adjusted under 35 U.S.C. 154(b) by 0 days.

(21) Appl. No.: 10/710,631

(22) Filed: Jul. 26, 2004

(65) Prior Publication Data

US 2006/0019761 A1 Jan. 26, 2006

(51) Int. Cl.
*A63D 15/08* (2006.01)

(52) U.S. Cl. ..... 473/44

(58) Field of Classification Search ..... 473/44–49
See application file for complete search history.

(56) References Cited

U.S. PATENT DOCUMENTS

| | | | | |
|---|---|---|---|---|
| 1,527,748 | A * | 2/1925 | Rambow | 473/47 |
| 2,726,185 | A * | 12/1955 | Howald | 156/174 |
| 3,232,613 | A | 2/1966 | Laube | |
| 4,943,333 | A * | 7/1990 | Chang | 156/153 |
| 6,110,051 | A * | 8/2000 | McCarty et al. | 473/44 |
| 6,162,128 | A | 12/2000 | McCarty et al. | |
| 6,736,733 | B2 * | 5/2004 | Yu | 473/44 |
| 7,044,861 | B1 * | 5/2006 | Nally et al. | 473/44 |
| 2002/0072424 | A1 * | 6/2002 | Yu | 473/44 |
| 2002/0082098 | A1 * | 6/2002 | Lai Chuang | 473/44 |
| 2002/0132677 | A1 * | 9/2002 | Chang | 473/44 |
| 2003/0036434 | A1 * | 2/2003 | Wu | 473/44 |
| 2003/0153393 | A1 * | 8/2003 | Chang | 473/44 |

FOREIGN PATENT DOCUMENTS

| | | |
|---|---|---|
| CA | 1 323 889 | 11/1993 |
| DE | 91 07 864.4 | 9/1991 |
| GB | 2 237 516 A | 5/1991 |
| GB | 2237516 A * | 5/1991 |

OTHER PUBLICATIONS

Yak Pool Cues and Accessories Web Page, "See Why Deflection Hurts Your Game So Bad!" Http://www.yakcues.com/XDshaft.htm, dated Nov. 2, 2004, 1 page.

Adonis® Baltic Timber Group Web Page, "Spruce—*Picea abies*—'whitewood'" Http://www.adonis.ee/spruce.htm, dated Nov. 2, 2004, pp. 1-3.

Yak Pool Cues and Accessories Web Page, Pool Cue Shaft Maintenance Products, Http://www.yakcues.com/Poolsupplies.htm, dated Nov. 2, 2004, pp. 1-6.

* cited by examiner

*Primary Examiner*—Mark S Graham
(74) *Attorney, Agent, or Firm*—Hamilton, Brook, Smith & Reynolds, P.C.

(57) ABSTRACT

A unique and improved billiard cue shaft is disclosed. The billiard cue shaft includes a core of light wood such as spruce and a skin of composite material such as carbon fiber/epoxy. The very light core combined with the extremely strong composite skin allow the billiard cue shaft to be very stiff where required without being too heavy and very light in areas where low mass is most critical for maximum performance while maintaining adequate stiffness. The shaft can be capped watertight at both ends to have none of the stability problems of a wood shaft while maintaining substantially all the feel and sound of a solid wood shaft.

1 Claim, 4 Drawing Sheets

HYBRID BILLIARD CUE SHAFT

BACKGROUND ART

A billiard cue is basically a tapered shaft with a tip attached to the very front end for making the contact with the cue ball. Billiard cues may have one or more releasable joints along their length. The shaft or shafts that form the body of a billiard cue have been made from a great variety of materials. There are prior billiard cue shafts which include a wood core and a skin of composite material such as glass fiber/epoxy or carbon fiber/epoxy. These prior shafts are made with a maple or other hard and heavy (11-12 g/ci) wood core and coated with a thin skin of low grade composite material. These low strength composite skins may increase stiffness slightly but they also add weight. Because these materials average about 2½ times the density of the wood core, the prior composite coated wood shafts are heavier than like sized solid wood shafts which is particularly undesirable for the first few inches of the tip end of a cue; indeed, U.S. Pat. No. 6,162,128 describes a way of reducing the mass of the first few inches of a solid maple shaft by boring a hole which removes only a few grams but has proven to improve performance (by reducing "cue ball deflection") and shafts built this way have become quite popular with top players. Another issue is straightness; the kinds of hardwoods used in prior composite coated wood shafts tend to be rather unstable and it is predictable that the wood cores are not perfectly straight to begin with. The coating is likely somewhat unevenly applied and the shaft is then centerless sanded and in the end result these shafts are not any straighter on average than solid wood shafts. One advantage these shafts have is that they do not get dinged up on the surface like pure wood shafts do, but in spite of this advantage they have never become popular with the better players.

DISCLOSURE OF INVENTION

Figure 1:
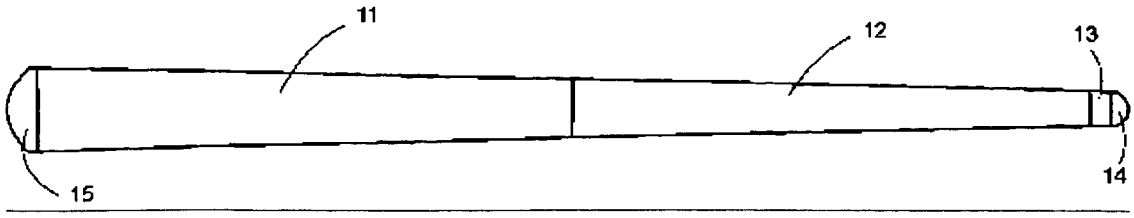
FIG. 1 shows the overall configuration of a common two piece billiard cue joined at the middle with a releasable joint. The front half of the cue includes a shaft 12, a tip cap 13, and a tip 14. The back half of the cue includes a shaft 11 and a butt cap 15.
Figure 2:
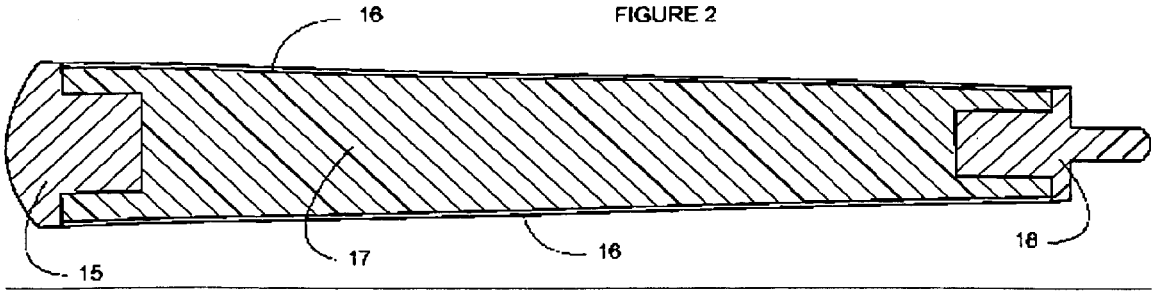
FIG. 2 shows a longitudinal cross section of the back half of a cue made using the present invention. The light wood core 17 is coated with the composite skin 16. The shaft is capped water tight at the front by joint section 18, and at the back by butt cap 15.
Figure 3:
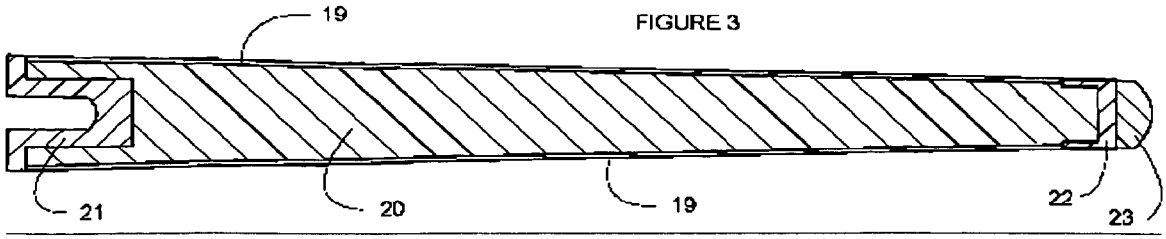
FIG. 3 shows a longitudinal cross section of the front half of a cue using the present invention. The light wood core 20 is coated with the composite skin 19. The shaft is capped water tight at the front by tip cap 22, and at the back by joint section 21. A tip 23 is attached to the tip cap 22.
Figure 4:
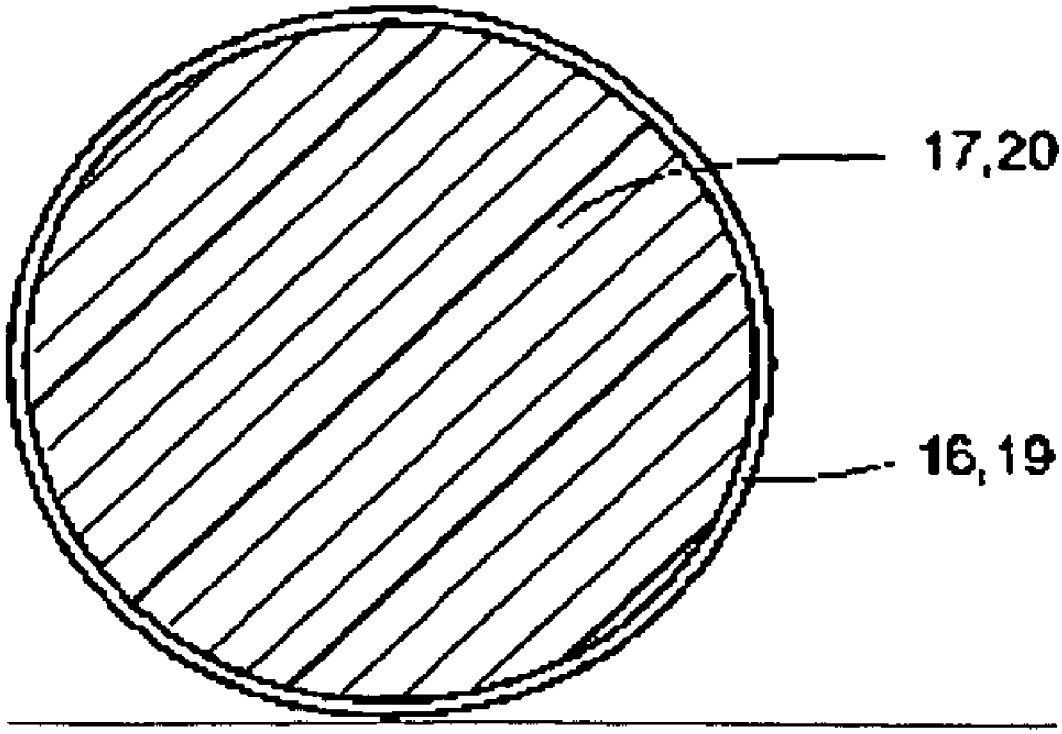
FIG. 4 shows a typical lateral cross section of the shaft. The light wood core 17,20 is coated with the composite skin 16,19.

A unique and improved billiard cue shaft is disclosed. The billiard cue shaft includes a light wood core such as Sitka Spruce (6-8 g/ci), and a composite outer skin such as glass fiber/epoxy or carbon fiber/epoxy. Sitka Spruce has perhaps the highest strength to weight ratio of all woods known. The shaft is designed in such a way as to take advantage of the best properties of wood and the great strength, durability, and stability of modern composite materials. By forming the core of a light but also quite strong wood such as Sitka Spruce, the composite skin can be thicker in areas where a cue can benefit from being stiffer without becoming too heavy. The skin can be very thin close to the tip end which together with the light wood core allows the first few inches of a cue to be of lower mass than prior composite skinned wood shafts which in turn causes performance changes which many players prefer. Another advantage of this design is that the shaft can be manufactured with near perfect straightness and stability. Some light woods such as Sitka Spruce are much more stable than the most common and popular hard shaft woods such as maple and are easily machined to a nearly perfectly straight core section. The composite skin can be applied thick enough to allow final machining of the entire outer surface on centers to achieve near perfect final straightness. Both ends of the shaft can be capped water tight and the shaft should remain stable indefinitely.

The invention claimed is:

1. A billiard cue comprising:

a shaft including a wood core and a skin of composite material, the wood having a density below about 9 grams per cubic inch, the skin of the composite material having a thickness that varies continuously along a length of the shaft from a thinner skin towards a front end to a thicker skin toward a back end.

* * * * *